XP 4,366,625

United States Patent [19]

Gehmann

[11] 4,366,625

[45] Jan. 4, 1983

[54] AIMING DEVICE

[76] Inventor: Walter Gehmann, Karlstrasse 40, Karlsruhe I, Fed. Rep. of Germany, 7500

[21] Appl. No.: 227,758

[22] Filed: Jan. 23, 1981

[30] Foreign Application Priority Data

Feb. 8, 1980 [DE] Fed. Rep. of Germany ..... 3004636

[51] Int. Cl.[3] ..... F41G 1/08; F41G 1/26

[52] U.S. Cl. ..... 33/251; 33/242

[58] Field of Search ..... 33/233, 241, 242, 243, 33/244, 251; 42/15

[56] References Cited

U.S. PATENT DOCUMENTS

| | | | |
|---|---|---|---|
| 1,428,389 | 9/1922 | Miller | 33/251 |
| 2,167,012 | 7/1939 | Tetzlaff | 33/244 |
| 2,310,929 | 2/1943 | Beresky | 33/251 |
| 2,486,940 | 11/1949 | Garber et al. | 33/242 |
| 2,498,706 | 2/1950 | Pease et al. | 33/242 |
| 3,456,351 | 7/1969 | Gehmann | 33/251 |

FOREIGN PATENT DOCUMENTS

| | | | |
|---|---|---|---|
| 1919031 | 10/1970 | Fed. Rep. of Germany | 33/251 |
| 2704660 | 10/1978 | Fed. Rep. of Germany | 33/251 |
| 144373 | 3/1954 | Sweden | 33/251 |

*Primary Examiner*—Richard R. Stearns
*Attorney, Agent, or Firm*—Klaus J. Bach

[57] ABSTRACT

In an aiming device for sport rifles a sighting ring is concentrically supported within a tubular housing. The sighting ring consists of a hollow cylinder composed of lamellas supported at one end and having ramp-like portions at their other ends with inwardly bent fingers defining the sighting ring opening. Annular transparent discs surround the hollow cylinder, one supporting the hollow cylinder at its one end and the other being axially movable and capable of compressing the lamellas to reduce, when moved over the ramp-like portions, the size of the opening and also the outer diameter of the sighting ring. The transparent discs consist of hub sleeves and outer sleeves interconnected by radial spring-steel strips oriented in viewing direction to provide only little obstruction.

7 Claims, 7 Drawing Figures

AIMING DEVICE

BACKGROUND OF THE INVENTION

1. Field of the Invention

The invention relates to an aiming device for sport rifles comprising a sighting ring of variable diameter.

2. Description of the Prior Art

The sighting ring of this type of aiming device includes an opening formed by elastic metal lamellas arranged closely adjacent each other within a tubular housing. Together they form a hollow cylinder centrally disposed around the line of sight of the aiming device. At their free ends, the lamellas extend ramp-like outwardly and have radially inwardly projecting fingers. A sliding control disc is disposed around the lamellas and is axially movable along the ramp-like section of the lamellas for forcing the lamellas inwardly adjusting the size of the opening formed by the lamellas.

When aiming with such an aiming device the target area should be seemingly surrounded by the sighting ring. In view of changing distance and different lighting conditions as well as varying dispositions of the rifleman, however, such result can be achieved only if the inner diameter of the sighting ring can be adjusted for the various conditions.

An aiming device of this type known in the art has a sighting ring consisting essentially of a hollow cylinder provided with axial slots to form lamellas which are ramp-like bent outwardly with radially inwardly extending end portions which surround the line of sight. An axially movable sleeve surrounds the hollow cylinder and is axially movable onto the ramp portion of the lamellas thereby variably compressing the lamellas for changing the diameter of the sighting ring formed by the lamellas. The hollow cylinder and the movable sleeve are supported in the housing by means of cross-bars.

A disadvantage of this kind of aiming device is the fact that a large part of the target area is covered by the cross-bars and also by the annular sighting ring itself. It is to be considered that the outside diameter of the cylinder and sleeve assembly will not change even when the inner diameter of the sighting ring is reduced; this results only in greater radial thickness of the sighting ring by reduction of the inner diameter. Many rifle sportsmen are also distracted by the radial bars which are irritating if the target area contains a cross-bar.

Desirably therefore the annular structure forming the sighting ring should remain relatively narrow independently of the size of its opening and the sighting ring support should not be distractive in any manner.

SUMMARY OF THE INVENTION

An aiming device for sport rifles which consists of a tubular housing has a sighting ring centrally supported therein by a support disc. The sighting ring consists of a hollow cylinder supported at one end thereof by the support disc and having extending therefrom lamellas with ramp-like ends bent inwardly to define the sighting ring opening. A control disc is slidably disposed in said housing and surrounds the hollow cylinder to compress the lamellas for adjustment of the sighting ring opening. The support and control discs are essentially transparent, consisting of thin hub sleeves and outer sleeves interconnected by radial spring steel strips oriented in viewing direction so as to provide for a reduction in outer sighting ring diameter when the sighting ring opening is reduced.

With this arrangement there are no view obstructing support bars for the sighting ring, and since also the adjustment disc is essentially transparent, both the inner and the outer limits of the sighting ring are defined by the lamellas of the hollow cylinder. As these lamellas are compressed when the inner diameter of the sighting ring is reduced, there will, at the same time, also the outer diameter of the sighting ring be reduced, the radial thickness of the sighting ring remaining unchanged for any selected sighting ring opening.

Consequently, the present invention overcomes the disadvantages associated with similar arrangements presently in use since widening of the sighting ring upon when reduction of the ring opening is avoided.

The shape and size of the desired reticle structure then depends only on the wishes of the rifleman; they are not determined by any functional requirements of the aiming device.

Since the lamellas of the hollow cylinder are spaced from each other and the gaps between the lamellas widen toward the outer edge, the outer edge of the sighting ring formed thereby is serrated. In order for the outer edge to appear round to the viewer there is preferably provided a lamella cage surrounding the hollow cylinder in such a way that the lamellas of the cage cover the gaps between the lamellas of the hollow cylinder. For manufacturing reasons the lamella cage may be formed to define a ramp at one end with the adjacent lamellas of the hollow cylinder being bent outwardly by 90° and again inwardly by 180° to form a flange adjacent the front edge of cage lamellas. Alternatively, the lamellas of the hollow cylinder may simply be bent inwardly.

Another possible solution for covering the gaps between the cylinder lamellas resides in the provision of extensions connected to the cylinder lamellas, which extensions overlie adjacent lamellas thereby covering the gaps therebetween.

The aiming device may include a rotatable disc of polarizing material, so that it is possible to blank out the space of the target area surrounding the sighting ring in the housing in a continuous manner. Such rotatable disc may be positioned in front of the sighting ring within the sighting ring housing which, furthermore, may include various coloring discs which may have central openings.

Experience has shown that sleeve and support discs of glass or plastic cannot easily withstand the vibrations and forces caused by use of relatively high-powered ammunition especially if such high-powered ammunition is used frequently. Problems may arise because the disc material is too brittle or, if consisting of plastic, the hollow cylinder which forms the sighting ring is not supported securely enough.

The transparent discs are therefore formed by concentric sleeves interconnected by spoke-like flat of spring steel oriented so as to provide only little obstruction to the viewer. At least three such strips are used and if three strips are used, they are arranged in the form of a Y. Preferably, however, four such strips are used and they are arranged at 90° angles. Discs formed in this manner are insensitive to impacts. Misadjustment of the sighting ring does not occur even if high-powered ammunition is frequently used since the metallic support is somewhat elastic. It will accept impact forces and, after any resilient dislocation, will return to its original position. The spoke-like strips of spring steel are connected to an inner metal sleeve which is firmly connected to the hollow cylinder forming the sighting ring or the lamella cage surrounding the hollow cylinder so that relative movement as it may be caused by shock will not occur and the sighting ring and/or the lamella cage remain securely positioned within the housing.

DESCRIPTION OF THE PREFERRED EMBODIMENT

Figure 1:
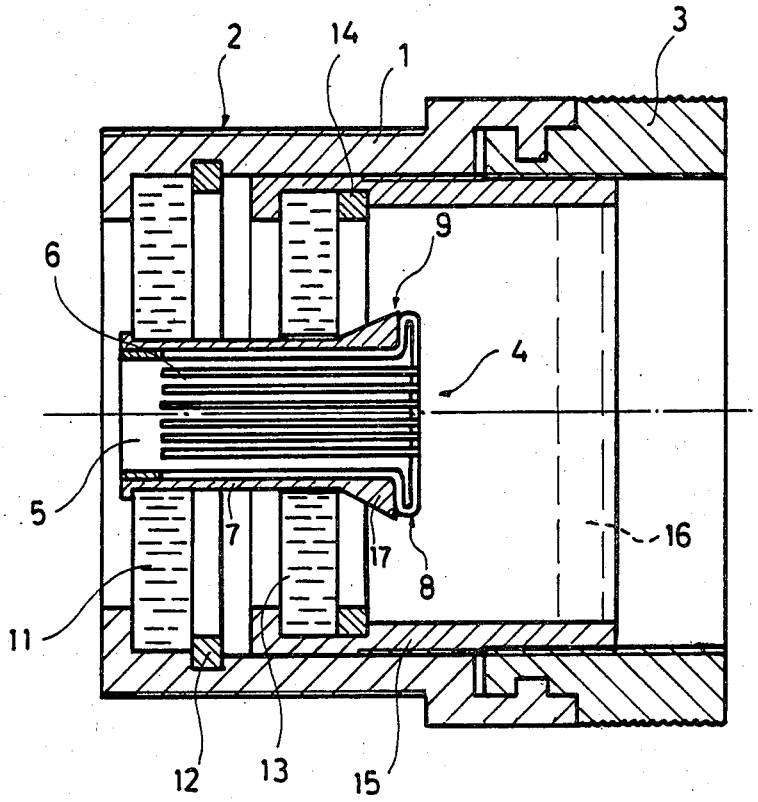
FIG. 1 is a longitudinal cross-sectional view of a sighting ring arranged in the housing of the aiming device.

As shown in FIG. 1, the aiming device includes a tubular housing 1 threaded at the outside at 2 for mounting in a tube supported on the barrel of a rifle. The housing 1, the mounting tube and an adjustment ring 3 together form an aiming tunnel within which a sighting ring 4 is supported. The sighting ring 4 consists of a hollow cylindrical member 5 having axial slots extending from one end thereof to form lamellas 6. The hollow cylinder 5 is surrounded by a lamella cage 7, whose lamellas have ramp-like ends 17. The lamellas of the hollow cylinder 5 are bent outwardly at their free ends adjacent the face of the ramp area 17 of the lamella cage 7 and are then bent radially inwardly to define the opening of the sighting ring 4. The outer circumference of the sighting ring 4 is formed by the edges 8 and 9 of the lamellas 6 and the ramp area 17 respectively.

At one end, the hollow cylinder 5 is firmly connected to the lamella cage 7 as by cementing. The sighting ring so formed by the hollow cylinder 5 and the cage 7 is supported at its end opposite said ramp area 17 in a transparent ring structure 11 which as shown in FIG. 1 is a disc consisting of a transparent plastic material. The disc 11 is supported in the housing 1 and is retained in place by a spring ring 12. The housing 1, being threaded into a tube mounted on the barrel of the rifle, firmly positions the sighting ring with respect to the barrel of the rifle.

Figure 2:
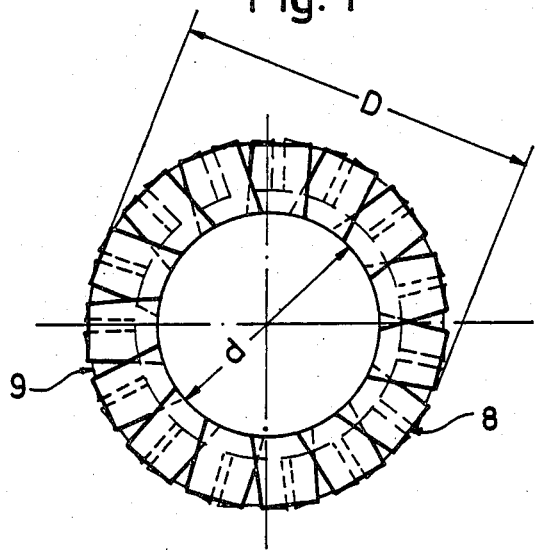
FIG. 2 is a front view of the sighting ring.

An additional transparent control disc 13 which may also include transparent plastic is arranged around the sighting ring 4 adjacent the ramp area 17 of the lamellas 10 of the lamella cage 7. The disc 13 is supported in a threaded sleeve 15 held in place by means of a spring ring 14. The threaded sleeve 15 is slotted and spring biased outwardly where it is threadedly engaged by the adjustment ring 3. Rotation of the adjustment ring 3 causes axial movement of the disc 13 which, when riding onto the ramp area 17, will compress the lamellas 6 of the hollow cylinder 5 and the lamella cage 7 for adjustment of the size of the sighting ring opening, that is for a reduction of the inner diameter d as well as the outer diameter D of the sighting ring (FIG. 2).

The disc 11 may include polarizing plastic material such that, in combination with an additional polarizing disc in the aiming device, the aiming area between the sighting ring 4 and the housing 1 can be steplessly darkened. It is also possible to arrange a polarizing disc 16 with or without central opening in the threaded sleeve 15 or in front of the sighting ring such that the whole area visible through the sighting ring tunnel may be darkened.

Figure 3:
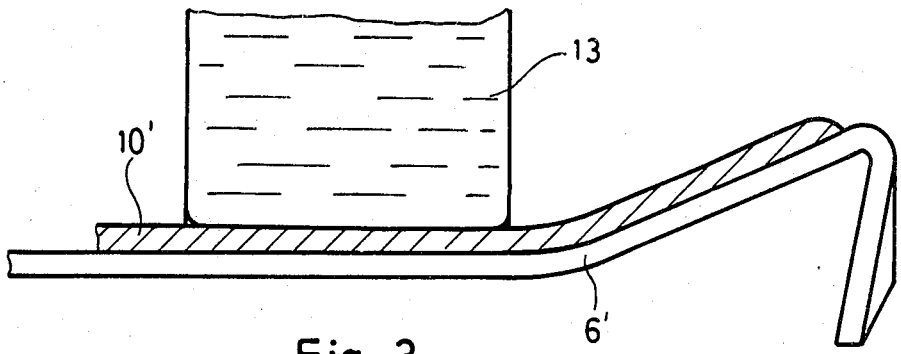
FIGS. 3 to 5 show schematically various solutions for providing adjustable sighting ring.
Figure 4:
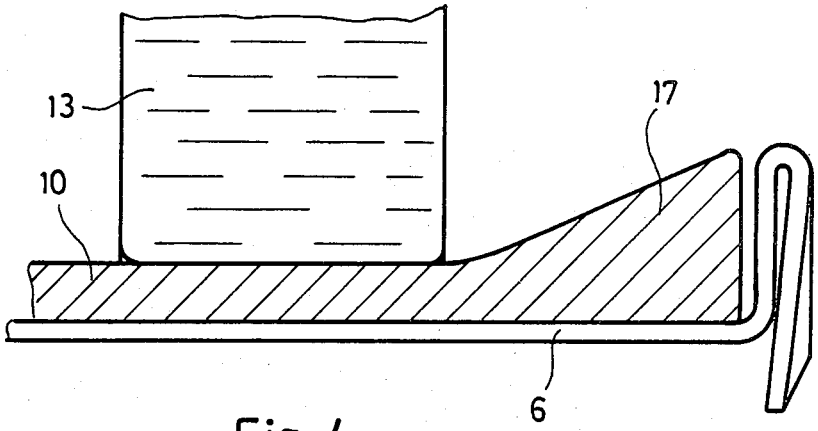
Figure 5:
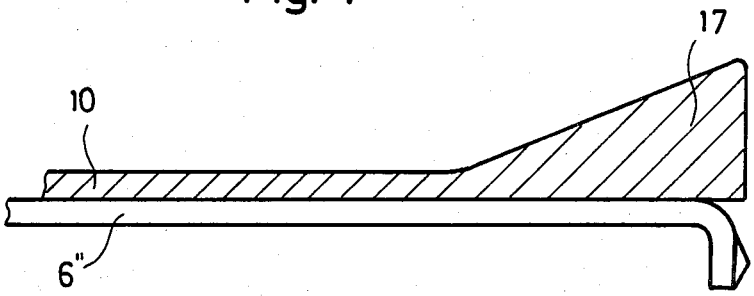

FIG. 3 shows an arrangement wherein the lamellas 6' of the hollow cylinder 5 as well as the lamellas 10' of the lamella cage 7 are bent outwardly to form the ramp 9. FIG. 4 shows an arrangement wherein the lamellas 10 have thickened ends 17 to form the ramp 9 and the lamellas 6 of the cylinder 5 are bent out—and again inwardly; and FIG. 5 shows an arrangement wherein the lamellas 6'' of the cylinder 5 are bent only inwardly.

Figure 6:
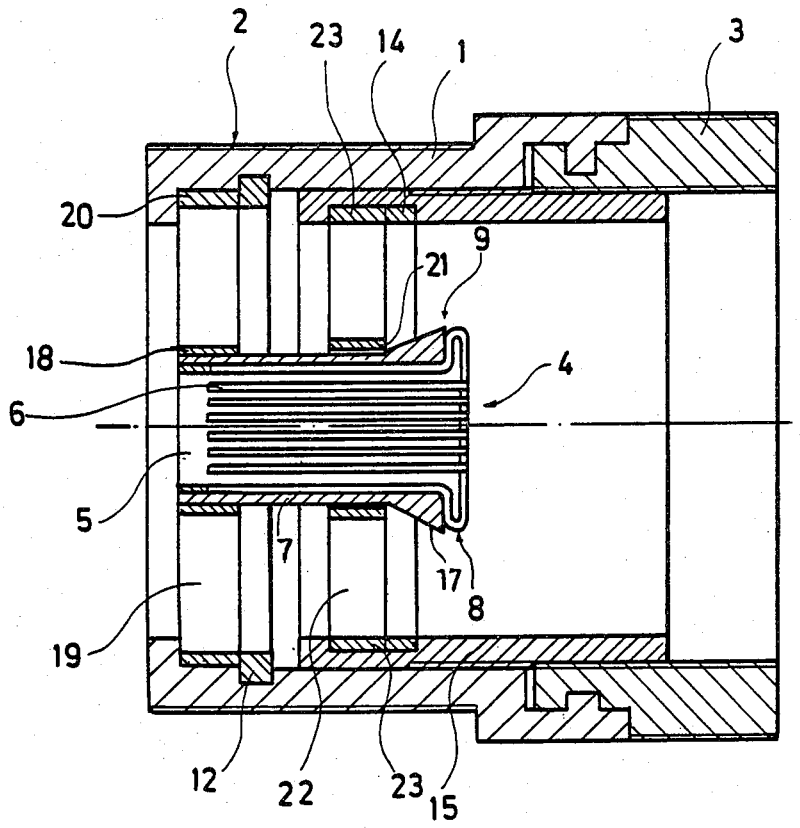
FIG. 6 is a view similar to FIG. 1 showing, however, the use of different transparent support and adjustment discs.
Figure 7:
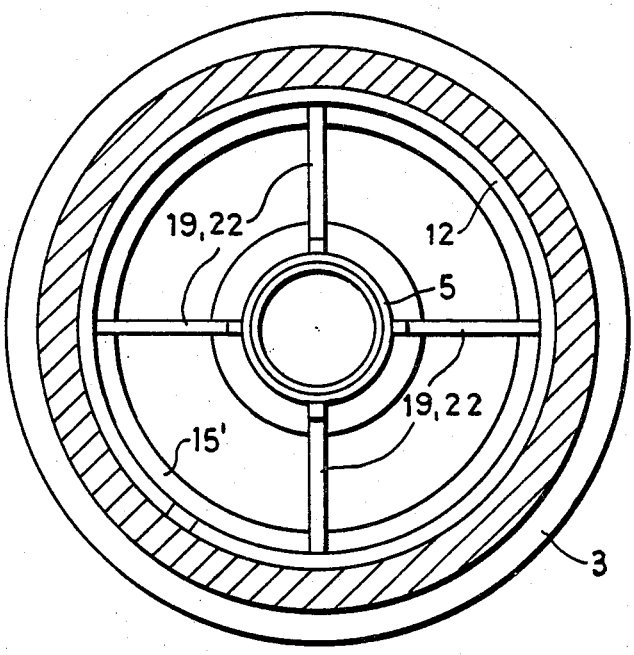
FIG. 7 is a front view of a disc as used in connection with the embodiment of FIG. 6.

As shown in FIGS. 6 and 7, the hollow cylinder 5 may be firmly connected to the lamella cage 7 at one end thereof for example by brazing. The sighting ring may then be supported at the same end, that is the end opposite the ramp area 9 by a hub sleeve 18 which is firmly connected to the lamella cage 7 by soldering, for example. The hub sleeve 18 is supported by four flat thin strips 19 arranged at 90° intervals and extending radially between the hub sleeve 18 and an outer sleeve 20 to which they, too, may be connected by soldering. As shown in FIG. 6, the additional control disc 23 consists also of a hub sleeve 21 which is supported on an outer sleeve 15' by flat thin strips 22. The flat strips 19 and 22 of the two discs are advantageously so arranged that they are disposed exactly in line with one another such that only the front edge of the strips 22 of one of the discs is visible for the user of the aiming device.

What I claim is:

1. An aiming device for sport rifles comprising: a tubular housing forming a sighting ring tunnel; a sighting ring concentrically supported by a support disc within said housing and consisting of a hollow cylinder composed of elastic metal lamellas disposed adjacent each other and having ramp-like end portions with inwardly bent ends; a control disc surrounding said hollow cylinder and slidably supported in said housing; means for moving said control disc along said hollow cylinder and onto said ramp-like end portion to thereby compress said lamellas for adjustment of the opening of said sighting ring, said hollow cylinder being supported by a support disc mounted in said housing, and said support and control discs including hub sleeves and outer sleeves interconnected by thin radial strips consisting of spring steel and being oriented in axial direction within said tubular housing, said sleeves providing for a large transparent area therebetween such that compression of said lamellas for reduction of the opening of said sighting ring also results in a reduction of the size of the sighting ring.

2. An aiming device as claimed in claim 1, wherein said hollow cylinder is surrounded by a lamella cage whose lamellas are so arranged that they overlay the slots between the lamellas of said hollow cylinder.

3. An aiming device as claimed in claim 2, wherein the lamellas of said lamella cage have ramp-like end portions and the lamellas of said hollow cylinder are bent outwardly by 90° adjacent the ramp-like end portions and are then bent inwardly by 180° to define the sighting ring opening.

4. An aiming device as claimed in claim 2, wherein the lamellas of said lamella cage have ramp-like end portions and the lamellas of said hollow cylinder have inwardly bent ends defining said sighting ring opening.

5. An aiming device as claimed in claim 1, wherein a polarizing disc is arranged in said housing in front of said sighting ring.

6. An aiming device as claimed in claim 5, wherein said means for moving said control disc is a threaded sleeve and said polarizing disc is mounted in said sleeve.

7. An aiming device as claimed in claim 1, wherein four radial strips are arranged at 90° angles so as to form a reticle.

* * * * *